US012747548B2

(12) United States Patent
Wang

(10) Patent No.: US 12,747,548 B2
(45) Date of Patent: Sep. 29, 2026

(54) VIADUCT STRUCTURE

(71) Applicant: Jianyou Wang, Wenzhou (CN)

(72) Inventor: Jianyou Wang, Wenzhou (CN)

( * ) Notice: Subject to any disclaimer, the term of this patent is extended or adjusted under 35 U.S.C. 154(b) by 912 days.

(21) Appl. No.: 18/153,081

(22) Filed: Jan. 11, 2023

(65) Prior Publication Data

US 2023/0167613 A1 Jun. 1, 2023

Related U.S. Application Data

(63) Continuation-in-part of application No. PCT/CN2021/105875, filed on Jul. 13, 2021.

(30) Foreign Application Priority Data

Jul. 20, 2020 (CN) ..... 202010741841.3

(51) Int. Cl.

| | |
|---|---|
| ***E01D 2/00*** | (2006.01) |
| ***E01D 19/02*** | (2006.01) |
| ***E01D 19/12*** | (2006.01) |
| ***E01D 101/24*** | (2006.01) |
| ***E01D 101/30*** | (2006.01) |

(52) U.S. Cl.

CPC ..... *E01D 2/00* (2013.01); *E01D 19/02* (2013.01); *E01D 19/125* (2013.01); *E01D 2101/24* (2013.01); *E01D 2101/30* (2013.01)

(58) Field of Classification Search

CPC .... E01D 2/00; E01D 2/02; E01D 1/00; E01D 19/02; E01D 19/083; E01D 19/125

See application file for complete search history.

(56) References Cited

U.S. PATENT DOCUMENTS

2009/0077758 A1* 3/2009 Vincent ..... E01D 22/00 14/73
2017/0204573 A1* 7/2017 Luo ..... E01D 21/00

FOREIGN PATENT DOCUMENTS

| | | | | |
|---|---|---|---|---|
| CN | 101597887 A | * | 12/2009 | |
| CN | 102953320 A | * | 3/2013 | |
| CN | 205329523 U | | 6/2016 | |
| CN | 106149540 A | | 11/2016 | |
| CN | 110042745 A | | 7/2019 | |
| CN | 110644361 A | * | 1/2020 | ..... E01D 19/125 |
| CN | 210712428 U | * | 6/2020 | |
| CN | 213507987 U | | 6/2021 | |

(Continued)

OTHER PUBLICATIONS

International search report of PCT/CN2021/105875.

*Primary Examiner* — Abigail A Risic

(57) ABSTRACT

Provided is a viaduct structure. The viaduct structure consists of steel bridge columns, steel plate girders, a bridge deck bottom steel plate, bridge deck side steel plates and cement-gravel concrete, where the steel bridge columns, the steel plate girders and the bridge deck bottom steel plate are welded to one another to form the ceiling type steel architecture, the bridge deck side steel plates are welded to the bridge deck bottom steel plate, and the cement-gravel concrete is poured in a groove-like structure formed by the bridge deck side steel plates and the bridge deck bottom steel plate. The viaduct structure has the advantages of a firm structure, a thin bridge deck, the thin steel plate girders, a low height of the bridge deck, no plywoods required for pouring, convenient construction, low waste, a low material consumption, a low construction cost, a short construction period, etc.

12 Claims, 7 Drawing Sheets

(56) References Cited

FOREIGN PATENT DOCUMENTS

| | | | | |
|---|---|---|---|---|
| JP | 2015042836 | A | * | 3/2015 |
| JP | 2018197495 | A | | 12/2018 |

* cited by examiner

VIADUCT STRUCTURE

CROSS REFERENCE TO RELATED APPLICATION

The present application claims the priority to Chinese Patent Application No. 202010741841.3, filed to the Chinese Patent Office on Jul. 20, 2020 and entitled "VIADUCT STRUCTURE", which is incorporated in its entirety herein by reference.

TECHNICAL FIELD

The present application relates to a highway bridge structure, and in particular to a viaduct taking a ceiling type steel architecture as a basis, having an extremely-thin bridge deck, extremely-thin bridge girders, the low bridge deck, a short approach bridge or an approach bridge having a small slope, and featuring no plywoods required for pouring, low waste, a low material consumption, a low construction cost and a short construction period.

BACKGROUND ART

A current viaduct is of a reinforced concrete structure, and consists of bridge columns, bridge girders and a bridge deck. Reinforcing steel bars of the viaduct are welded vertically and horizontally to form a mesh structure. A reinforcing mesh is coagulated inside cement-gravel concrete, has a porous structure and cannot form a ceiling type steel architecture. The structure is not firm, and thus it is necessary to add a large amount of cement and sand concrete. The bridge columns are extremely large, and the bridge deck and the bridge girders are extremely thick, such that materials are greatly wasted, and moreover, the height of the bridge deck is greatly increased. Accordingly, an approach bridge becomes long, and has a large slope, and it is necessary to wrap the bridge columns, the bridge girders and the bridge deck with plywoods during pouring, so as to prevent cement slurry from flowing out, thereby resulting in construction troubles, and further resulting in waste of the plywoods, long engineering time, cost increase, and a high construction cost.

SUMMARY

In order to solve the problem existing in the above viaduct structure, the objective of the present application is to provide a viaduct taking a ceiling type steel architecture as a basis, having an extremely-thin bridge deck, extremely-thin bridge girders, the low bridge deck, a short approach bridge or an approach bridge having a small slope, and featuring no plywoods required for pouring, low waste, a low material consumption, convenient construction and a low construction cost.

In order to achieve the objective, the present application uses the following technical solution:

the present application consists of steel bridge columns, steel plate girders, a bridge deck bottom steel plate, bridge deck side steel plates and cement-gravel concrete, where the steel bridge columns are made of steel, and may bear a large pressure, the steel plate girders are welded to upper portions of the steel bridge columns, the steel plate girder is an extremely long steel plate, the two steel plate girders are located above the steel bridge columns on a left side and a right side respectively, the steel plate girders have a length the same as that of a viaduct, the steel plate girders support a bridge deck and vehicles above, and play a role of bridge girders, the bridge deck bottom steel plate is welded to upper portions of the steel plate girders, the bridge deck bottom steel plate is a wide and long steel plate, a width of the bridge deck bottom steel plate is that of the bridge deck, the bridge deck bottom steel plate has a length the same as that of the viaduct, the bridge deck bottom steel plate completely seals a bottom of the bridge deck, and firmly supports the upper cement-gravel concrete and vehicles, the bridge deck bottom steel plate is completely welded to the steel plate girders and the steel bridge columns, to form a firm ceiling type steel architecture that may bear a pressure from a large number of automobiles, the bridge deck bottom steel plate is welded to the bridge deck side steel plates above on a left side and a right side, the bridge deck side steel plates on the left side and the right side and the bridge deck bottom steel plate together form a groove-like structure, the cement-gravel concrete is poured in the groove-like structure above the bridge deck bottom steel plate, the bridge deck side steel plates may prevent cement slurry from flowing out when the cement-gravel concrete is poured, and the cement-gravel concrete, the bridge deck bottom steel plate and the bridge deck side steel plates are bonded firmly.

On the basis of the above technical solution, when the steel bridge columns and the bridge deck bottom steel plate are sufficient to bear the weight of vehicles above, the steel plate girders, the bridge deck side steel plates and the cement-gravel concrete may be removed, in this case, a viaduct structure consists of the steel bridge columns and the bridge deck bottom steel plate, the steel bridge columns are lower portions of the viaduct, the steel bridge columns support the bridge deck bottom steel plate, the width of the bridge deck bottom steel plate is that of the bridge deck, the length of the bridge deck bottom steel plate is that of the viaduct, and the bridge deck bottom steel plate is welded to the steel bridge columns to form the ceiling type steel architecture that is strong and may bear the pressure from the bridge deck and numerous vehicles above; further, the bridge deck side steel plates may be mounted according to requirements, the bridge deck side steel plates are made of steel, the bridge deck side steel plates are welded to upper portions of the two sides of the bridge deck bottom steel plate, and the bridge deck side steel plates have the length the same as that of the viaduct, and the groove-like structure is formed by the bridge deck side steel plates on the left side and the right side and the bridge deck bottom steel plate; furthermore, according to the requirements of traveling, the cement-gravel concrete may be poured in the groove-like structure formed by the bridge deck side steel plates and the bridge deck bottom steel plate, the bridge deck side steel plates may prevent cement slurry from flowing out when the cement-gravel concrete is poured, and the cement-gravel concrete, the bridge deck side steel plates and the bridge deck bottom steel plate are coagulated together and bonded firmly.

Preferably, textured steel plates are used as the bridge deck bottom steel plate and the bridge deck side steel plates, and textures protrude into the cement-gravel concrete.

Preferably, reinforcing steel bars are welded on the bridge deck bottom steel plate, and the reinforcing steel bars protrude into the cement-gravel concrete.

Preferably, a layer of asphalt concrete is laid on the cement-gravel concrete; in order to reduce weight, the cement-gravel concrete may be replaced with cement-lava concrete; and a layer of cement-lava concrete may also be laid under the cement-gravel concrete.

Preferably, guard rails are welded on the bridge deck bottom steel plate.

Preferably, guard rails are welded on the bridge deck side steel plates.

Preferably, the bridge deck sinks, and the bridge deck is flush with a ground, such that an underground passage becomes a tunnel, and a view of the ground is not affected.

Preferably, the steel bridge columns are replaced with bridge column steel plates, the steel plates are long, and thus also may support the steel plate girders and the bridge deck, and moreover, a room structure may be formed by the steel plates under a bridge, and a space under the bridge may be used for many purposes.

Preferably, after the steel bridge columns are replaced with the bridge column steel plates, ground steel plates are laid under the bridge column steel plates, and the ground steel plates are welded to the bridge column steel plates to improve firmness of the bridge column steel plates.

Preferably, piles are arranged at bottoms of the ground steel plates below the bridge column steel plates, and the piles may prevent the ground steel plates from sinking.

Preferably, the steel bridge columns, the steel plate girders, the bridge deck bottom steel plate, the bridge deck side steel plates and the bridge column steel plates are of hollow bore structures.

Preferably, the steel bridge columns are of a honeycomb hollow bore structure.

Compared with a current viaduct, the present application replaces original reinforced concrete bridge columns with the steel bridge columns, replaces original reinforced concrete bridge girders with the steel plate girders made of steel plates, and replaces an original reinforced concrete bridge deck with the composite bridge deck formed by wrapping the cement-gravel concrete with the bridge deck bottom steel plate and the bridge deck side steel plates, such that □ the bridge deck bottom steel plate, the steel plate girders, and the steel bridge columns are welded to one another to form the ceiling type steel architecture that is firm and may bear the large pressure; □ the bridge deck and the steel plates girders are extremely thin, the bridge deck has a low height, and an approach bridge is short or has a small slope; □ no plywoods is required for pouring, and construction is convenient; □ waste is low, material consumption is low, and a construction cost is low; and □ engineering time is short.

Figure 1:
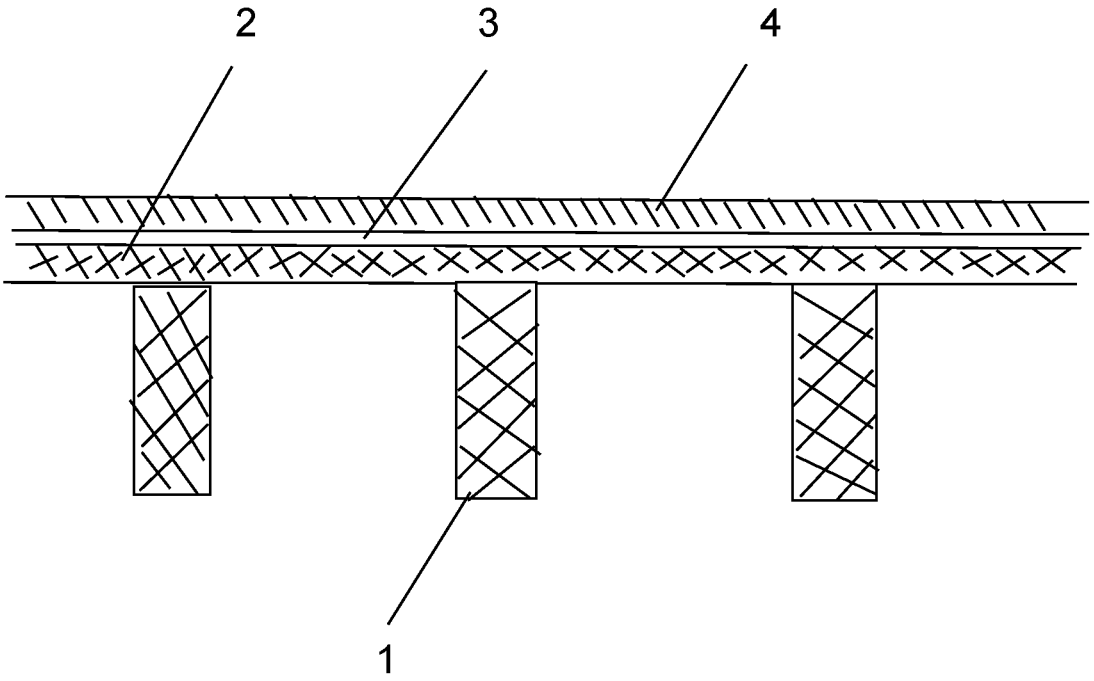
FIG. 1 is a longitudinal structural diagram (Example 1) of a viaduct.
Figure 2:
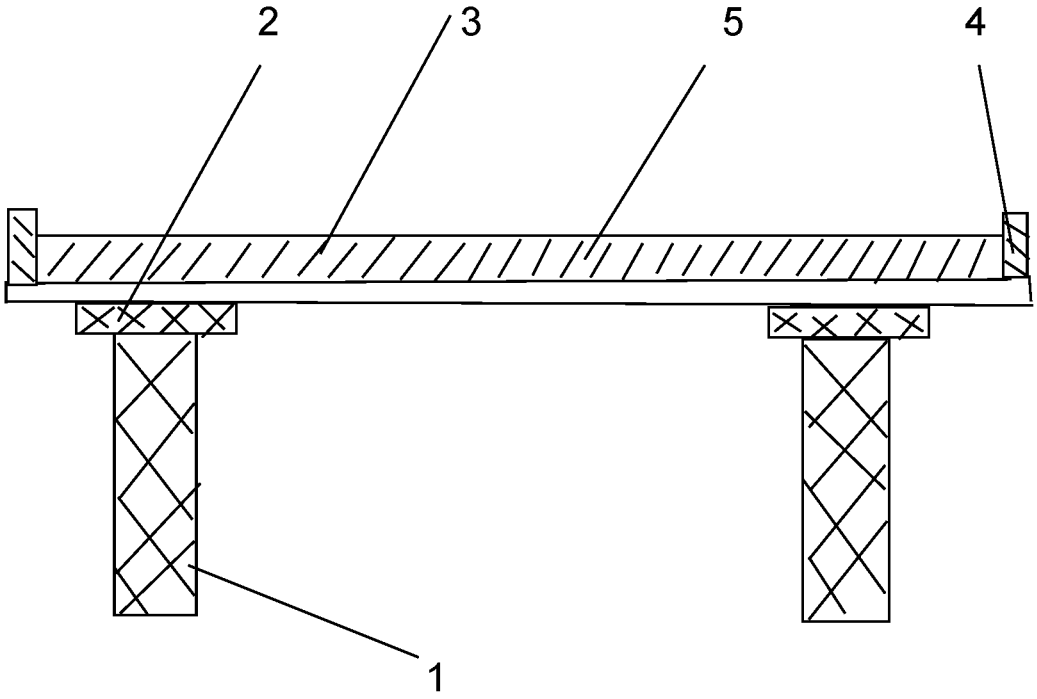
FIG. 2 is a transverse structural diagram (Example 1) of the viaduct.
Figure 3:
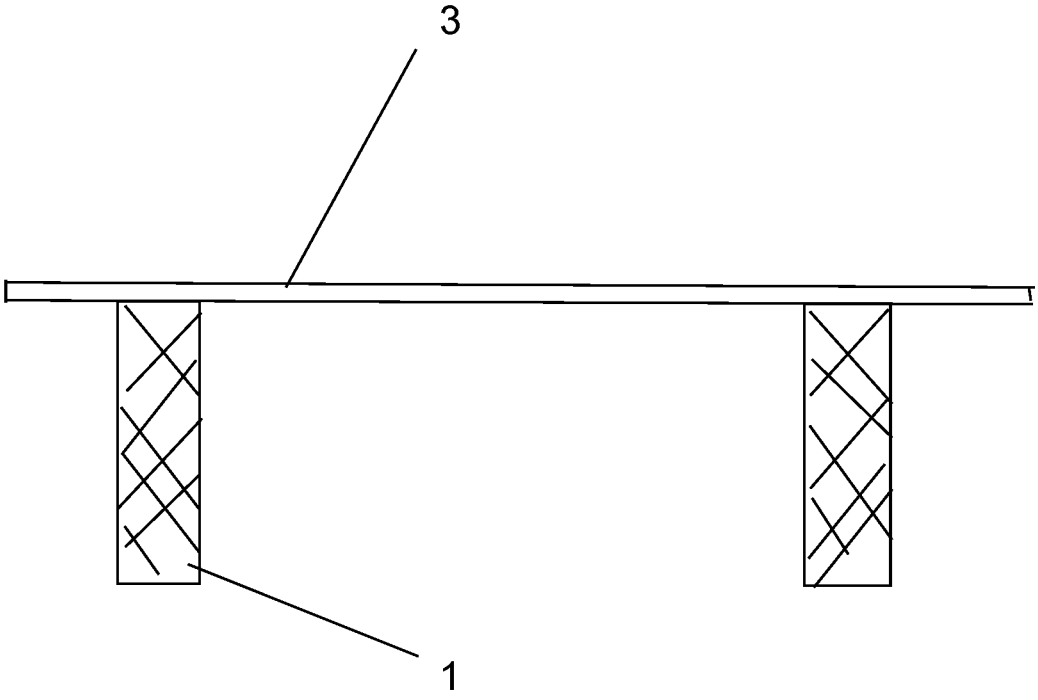
FIG. 3 is a transverse structural diagram (Example 2) of the viaduct.
Figure 4:
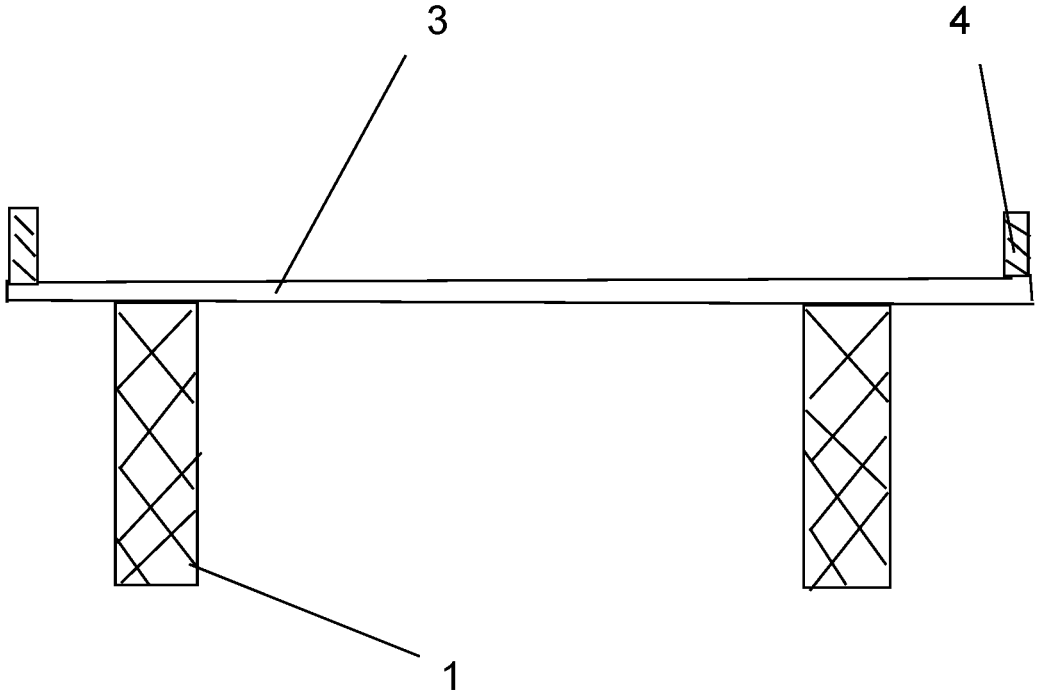
FIG. 4 is a transverse structural diagram (Example 3) of the viaduct.
Figure 5:
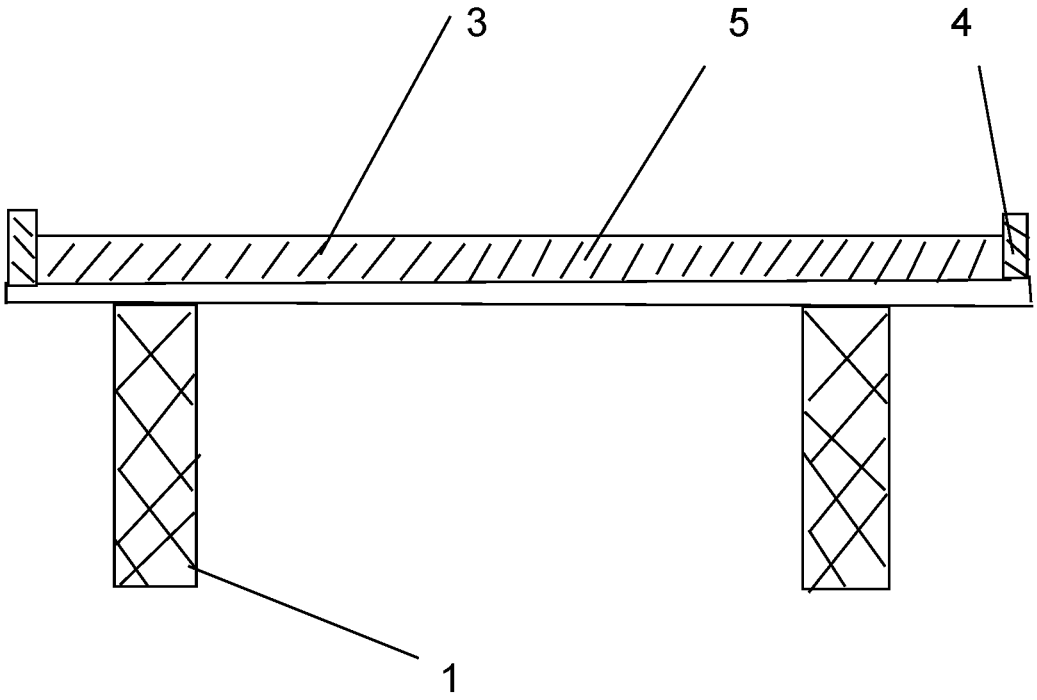
FIG. 5 is a transverse structural diagram (Example 4) of the viaduct.
Figure 6:
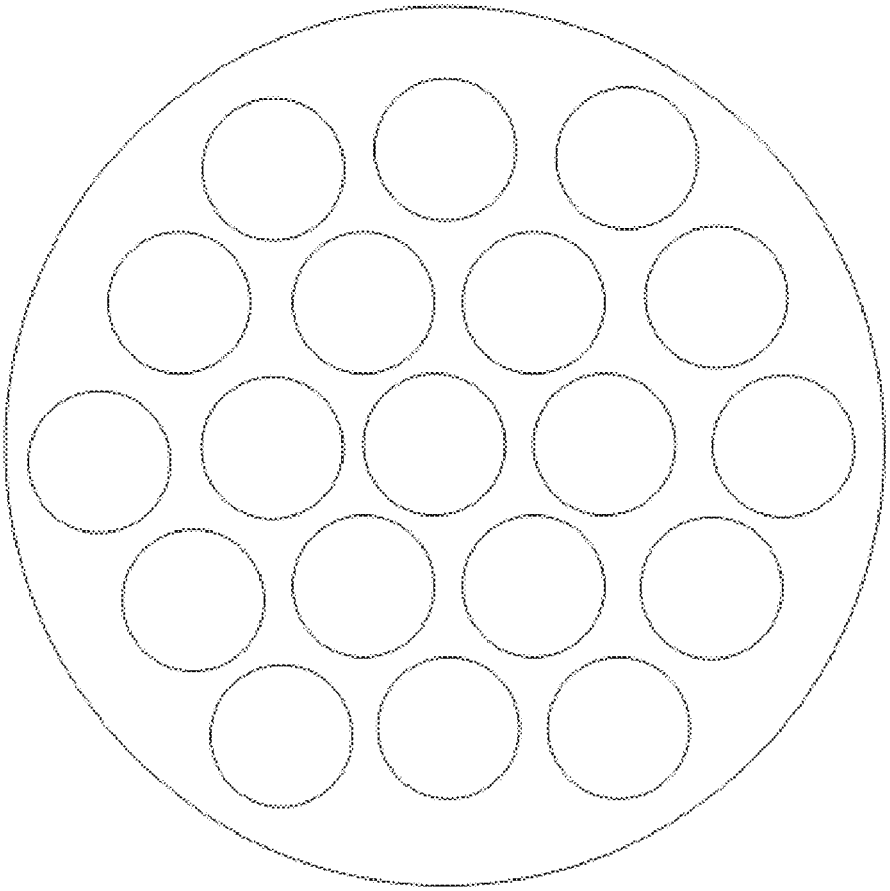
FIG. 6 is a diagrammatic cross-section of the hollow bore structures of the steel bridge columns.
Figure 7:
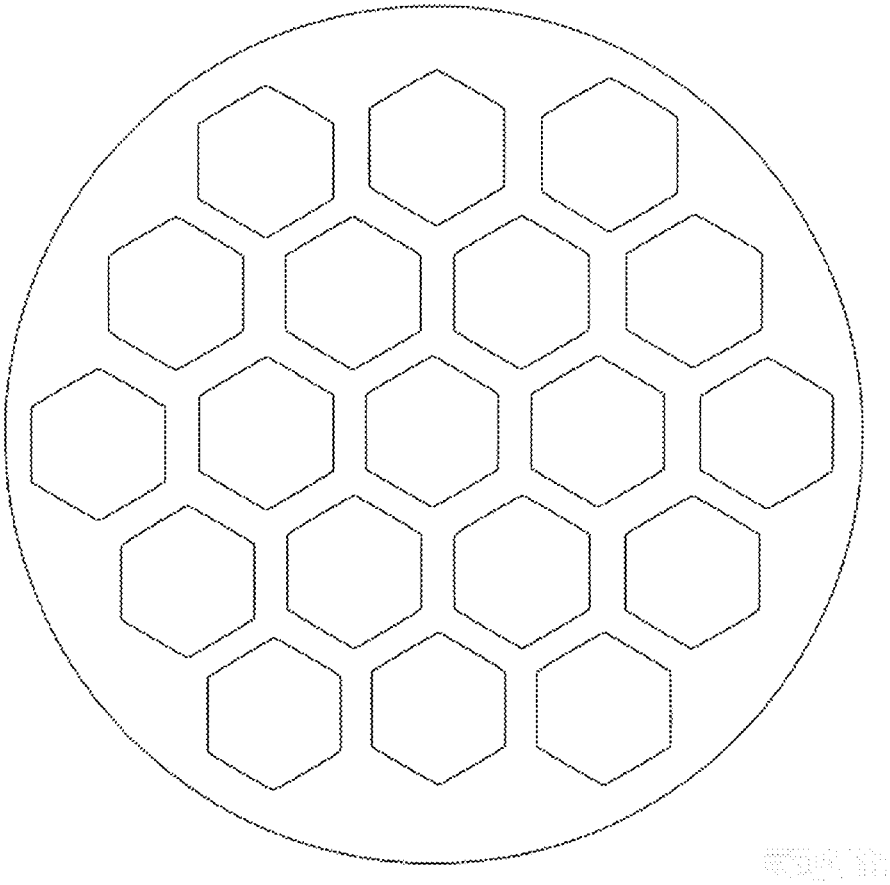
FIG. 7 is a diagrammatic cross-section of the honeycomb hollow structure of the steel bridge columns.
Figure 8:
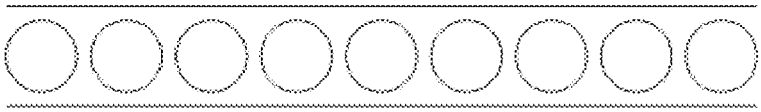
FIG. 8 is a diagrammatic cross-section of the hollow bore structures of the steel plate girders, the bridge deck bottom steel plate, and the bridge deck side steel plates.

In the figures: 1. steel bridge column; 2. steel plate girder; 3. bridge deck bottom steel plate; 4. bridge deck side steel plate; and 5. cement-gravel concrete.

DETAILED DESCRIPTION OF THE EMBODIMENTS

Example 1: a viaduct structure consists of steel bridge columns 1, steel plate girders 2, a bridge deck bottom steel plate 3, bridge deck side steel plates 4 and cement-gravel concrete 5, where the steel bridge columns 1, the steel plate girders 2, the bridge deck bottom steel plate 3 and the bridge deck side steel plates 4 are made of steel, the steel bridge columns 1 are lower portions of a viaduct, the steel bridge columns 1 support the steel plate girders and a bridge deck, the steel plate girders 2 are welded to upper portions of the steel bridge columns 1, a plurality of steel bridge columns 1 may be welded to a lower portion of one long steel plate girder 2, the steel plate girders 2 are thin and long, the steel plate girders 2 have a length the same as that of the viaduct, the steel plate girders 2 support the bridge deck above, upper portions of the steel plate girders 2 are welded to the bridge deck bottom steel plate 3, two steel plate girders 2 are located on a left side and a right side of the viaduct, the two steel plate girders 2 are welded at bottoms of a left side and a right side of the bridge deck bottom steel plate 3 respectively, a width of the bridge deck bottom steel plate 3 is that of the bridge deck, a length of the bridge deck bottom steel plate 3 is that of the viaduct, the bridge deck bottom steel plate 3 is sealed under the bridge deck, and may prevent cement slurry from flowing down when the cement-gravel concrete 5 above the bridge deck bottom steel plate 3 is poured, the bridge deck bottom steel plate 3 is welded to the steel plate girders 2 and the steel bridge columns 1, to form a ceiling type steel architecture that is firm and may bear the pressure from the bridge deck and numerous vehicles above, the bridge deck side steel plates 4 are welded to upper portions of two sides of the bridge deck bottom steel plate 3, the bridge deck side steel plates 4 have a length the same as that of the viaduct, a groove-like structure is formed by the bridge deck side steel plates 4 on a left side and a right side and the bridge deck bottom steel plate 3, the cement-gravel concrete 5 is arranged in the groove-like structure above the bridge deck bottom steel plate 3, the bridge deck side steel plates 4 may prevent cement slurry from flowing out when the cement-gravel concrete 5 is poured, and the cement-gravel concrete 5, the bridge deck side steel plates 4 and the bridge deck bottom steel plate 3 are coagulated together and bonded firmly.

Example 2: a viaduct structure consists of steel bridge columns 1 and a bridge deck bottom steel plate 3, where the steel bridge columns 1 and the bridge deck bottom steel plate 3 are made of steel, the steel bridge columns 1 are lower portions of a viaduct, the steel bridge columns 1 support the bridge deck bottom steel plate 3, a width of the bridge deck bottom steel plate 3 is that of a bridge deck, a length of the bridge deck bottom steel plate 3 is that of the viaduct, and the bridge deck bottom steel plate 3 is welded to the steel bridge columns 1, to form a ceiling type steel architecture that is firm and may bear the pressure from the bridge deck and numerous vehicles above.

Example 3: a viaduct structure consists of steel bridge columns 1, a bridge deck bottom steel plate 3 and bridge deck side steel plates 4, where the steel bridge columns 1, the bridge deck bottom steel plate 3 and the bridge deck side steel plates 4 are made of steel, the steel bridge columns 1 are lower portions of a viaduct, the steel bridge columns 1 support a bridge deck, upper portions of the steel bridge columns 1 are welded to the bridge deck bottom steel plate 3, a width of the bridge deck bottom steel plate 3 is that of the bridge deck, a length of the bridge deck bottom steel plate 3 is that of the viaduct, the bridge deck bottom steel plate 3 is welded to the steel bridge columns 1 to form a ceiling type steel architecture that is strong and may bear the pressure from the bridge deck and numerous vehicles above, the bridge deck side steel plates 4 are welded to upper portions of two sides of the bridge deck bottom steel plate 3, and the bridge deck side steel plates 4 have the length the same as that of the viaduct, and a groove-like structure is formed by the bridge deck side steel plates 4 on the left side and the right side and the bridge deck bottom steel plate 3.

Example 4: a viaduct structure consists of steel bridge columns 1, a bridge deck bottom steel plate 3, bridge deck side steel plates 4 and cement-gravel concrete 5, where the steel bridge columns 1, the bridge deck bottom steel plate 3 and the bridge deck side steel plates 4 are made of steel, the steel bridge columns 1 are lower portions of a viaduct, the steel bridge columns 1 support a bridge deck above, and are welded to the bridge deck bottom steel plate 3, a width of the bridge deck bottom steel plate 3 is that of the bridge deck, a length of the bridge deck bottom steel plate 3 is that of the viaduct, the bridge deck bottom steel plate 3 is sealed under the bridge deck, and may prevent cement slurry from flowing down when the cement-gravel concrete 5 above the bridge deck bottom steel plate 3 is poured, the bridge deck bottom steel plate 3 is welded to the steel bridge columns 1, to form a ceiling type steel architecture that is firm and may bear the pressure from the bridge deck and numerous vehicles above, the bridge deck side steel plates 4 are welded to upper portions of two sides of the bridge deck bottom steel plate 3, the bridge deck side steel plates 4 have a length the same as that of the viaduct, a groove-like structure is formed by the bridge deck side steel plates 4 on a left side and a right side and the bridge deck bottom steel plate 3, the cement-gravel concrete 5 is arranged in the groove-like structure above the bridge deck bottom steel plate 3, the bridge deck side steel plates 4 may prevent cement slurry from flowing out when the cement-gravel concrete 5 is poured, and the cement-gravel concrete 5, the bridge deck side steel plates 4 and the bridge deck bottom steel plate 3 are coagulated together and bonded firmly.

According to the several above examples:

Furthermore, textured steel plates are used as the bridge deck bottom steel plate 3 and the bridge deck side steel plates 4, and textures protrude into the cement-gravel concrete 5. Thus, the cement-gravel concrete 5 and the textured steel plates are coagulated together, and are firm.

Furthermore, reinforcing steel bars are welded on the bridge deck bottom steel plate 3, and the reinforcing steel bars protrude into the cement-gravel concrete 5. Thus, the cement-gravel concrete 5 and the bridge deck bottom steel plate 3 and the bridge deck side steel plates 4 are coagulated together, and are firm.

Furthermore, a layer of asphalt concrete is laid on the cement-gravel concrete 5. Thus, the cement-gravel concrete 5 on the bridge deck is not prone to crack. In order to reduce weight, the cement-gravel concrete may be replaced with cement-lava concrete; and a layer of cement-lava concrete may also be laid under the cement-gravel concrete.

Furthermore, guard rails are welded on the bridge deck bottom steel plate 3. Thus, the guard rails are firm.

Furthermore, guard rails are welded on the bridge deck side steel plates 4. Thus, the guard rails are firm.

Furthermore, the bridge deck sinks, and the bridge deck is flush with a ground, such that an underground passage becomes a tunnel, and a view of the ground is not affected.

Furthermore, the steel bridge columns 1 are replaced with bridge column steel plates, the steel plates are long, and thus also may support the steel plate girders 2 and the bridge deck, and moreover, a room structure may be formed by the steel plates under a bridge, and a space under the bridge may be used for many purposes.

Furthermore, after the steel bridge columns are replaced with the bridge column steel plates, ground steel plates are laid under the bridge column steel plates, and the ground steel plates are welded to the bridge column steel plates to improve firmness of the bridge column steel plates.

Furthermore, piles are arranged at bottoms of the ground steel plates below the bridge column steel plates, and the piles may prevent the ground steel plates from sinking.

Furthermore, the steel bridge columns 1, the steel plate girders 2, the bridge deck bottom steel plate 3, the bridge deck side steel plates 4 and the bridge column steel plates are of hollow bore structures.

Furthermore, the steel bridge columns 1 are of a honeycomb hollow bore structure.

What is claimed is:

1. A viaduct structure, consisting of
steel bridge columns (1),
steel plate girders (2),
a bridge deck bottom steel plate (3),
bridge deck side steel plates (4) and
cement-gravel concrete (5), wherein the steel bridge columns (1), the steel plate girders (2), the bridge deck bottom steel plate (3) and the bridge deck side steel plates (4) are made of steel, the steel bridge columns (1) are lower portions of a viaduct, the steel bridge columns (1) support the steel plate girders and a bridge deck, the steel plate girders (2) are welded to upper portions of the steel bridge columns (1), a plurality of steel bridge columns (1) can be welded to a lower portion of one long steel plate girder (2), the steel plate girders (2) are long, the steel plate girders (2) have a length the same as that of the viaduct, the steel plate girders (2) support the bridge deck above, upper portions of the steel plate girders (2) are welded to the bridge deck bottom steel plate (3), two steel plate girders (2) are located on a left side and a right side of the viaduct, the two steel plate girders (2) are welded at bottoms of a left side and a right side of the bridge deck bottom steel plate (3) respectively, a width of the bridge deck bottom steel plate (3) is that of the bridge deck, a length of the bridge deck bottom steel plate (3) is that of the viaduct, the bridge deck bottom steel plate (3) is sealed under the bridge deck, and can prevent cement slurry from flowing down when the cement-gravel concrete (5) above the bridge deck bottom steel plate (3) is poured, the bridge deck bottom steel plate (3) is welded to the steel plate girders (2) and the steel bridge columns (1), to form a ceiling type steel architecture that is firm and can bear the pressure from the bridge deck and numerous vehicles above, the bridge deck side steel plates (4) are welded to upper portions of two sides of the bridge deck bottom steel plate (3), the bridge deck side steel plates (4) have a length the same as that of the viaduct, a groove-like structure is formed by the bridge deck side steel plates (4) on a left side and a right side and the bridge deck bottom steel plate (3), the cement-gravel concrete (5) is arranged in the groove-like structure above the bridge deck bottom steel plate (3), the bridge deck side steel plates (4) can prevent cement slurry from flowing out when the cement-gravel concrete (5) is poured, and the cement-gravel concrete (5), the bridge deck side steel plates (4) and the bridge deck bottom steel plate (3) are coagulated together and bonded firmly;

wherein the steel bridge columns (1), the steel plate girders (2), the bridge deck bottom steel plate (3) and the bridge deck side steel plates (4) are of hollow bore structures.

2. The viaduct structure of claim 1, wherein a layer of asphalt concrete is laid on the cement-gravel concrete (5).

3. The viaduct structure of claim 2, wherein the cement-gravel concrete (5) can be replaced with cement-lava concrete.

4. The viaduct structure of claim 3, wherein a layer of cement-lava concrete is laid under the cement-gravel concrete while the layer of asphalt concrete is laid on the cement-gravel concrete (5).

5. A viaduct structure, consisting of steel bridge columns (1) and a bridge deck bottom steel plate (3), wherein the steel bridge columns (1) and the bridge deck bottom steel plate (3) are made of steel, the steel bridge columns (1) are lower portions of a viaduct, the steel bridge columns (1) support the bridge deck bottom steel plate (3), a width of the bridge deck bottom steel plate (3) is that of a bridge deck, a length of the bridge deck bottom steel plate (3) is that of the viaduct, and the bridge deck bottom steel plate (3) is welded to the steel bridge columns (1), to form a ceiling type steel architecture that is firm and can bear the pressure from the bridge deck and numerous vehicles above;

wherein the steel bridge columns (1) and the bridge deck bottom steel plate (3) are of hollow bore structures.

6. The viaduct structure of claim 5, further comprising bridge deck side steel plates (4), wherein the bridge deck side steel plates (4) are made of steel, the bridge deck side steel plates (4) are welded to upper portions of two sides of the bridge deck bottom steel plate (3), the bridge deck side steel plates (4) have a length the same as that of the viaduct, and a groove-like structure is formed by the bridge deck side steel plates (4) on a left side and a right side and the bridge deck bottom steel plate (3).

7. The viaduct structure of claim 6, further comprising cement-gravel concrete (5), wherein the cement-gravel concrete (5) is poured in the groove-like structure formed by the bridge deck side steel plates (4) and the bridge deck bottom steel plate (3), and the bridge deck side steel plates (4) can prevent cement slurry from flowing out when the cement-gravel concrete (5) is poured, and the cement-gravel concrete (5), the bridge deck side steel plates (4) and the bridge deck bottom steel plate (3) are coagulated together and bonded firmly.

8. The viaduct structure of claim 7, wherein a layer of asphalt concrete is laid on the cement-gravel concrete (5).

9. The viaduct structure of claim 8, wherein the cement-gravel concrete (5) can be replaced with cement-lava concrete.

10. The viaduct structure of claim 8, wherein a layer of cement-lava concrete is laid under the cement-gravel concrete while the layer of asphalt concrete is laid on the cement-gravel concrete (5).

11. The viaduct structure of claim 6, wherein the bridge deck side steel plates (4) are of a hollow bore structure.

12. The viaduct structure of claim 5, wherein the steel bridge columns (1) are of a honeycomb hollow structure.

* * * * *